US008571431B2

(12) United States Patent
Sekine

(10) Patent No.: US 8,571,431 B2
(45) Date of Patent: Oct. 29, 2013

(54) IMAGE FORMING APPARATUS INCLUDING TRANSFER ROLLER MECHANISM

(75) Inventor: Takuya Sekine, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 309 days.

(21) Appl. No.: 13/075,559

(22) Filed: Mar. 30, 2011

(65) Prior Publication Data

US 2011/0255910 A1 Oct. 20, 2011

(30) Foreign Application Priority Data

Apr. 16, 2010 (JP) ..... 2010-094956

(51) Int. Cl.
*G03G 15/16* (2006.01)

(52) U.S. Cl.
USPC ..... 399/66; 399/302; 399/313

(58) Field of Classification Search
USPC ..... 399/66, 302, 308, 303, 313
See application file for complete search history.

(56) References Cited

U.S. PATENT DOCUMENTS

| | | | | |
|---|---|---|---|---|
| 5,963,769 | A * | 10/1999 | Emukai et al. | 399/302 X |
| 6,477,349 | B2 * | 11/2002 | Kanekura et al. | 399/302 |
| 7,606,507 | B2 * | 10/2009 | Soshiroda | 399/66 |
| 7,813,683 | B2 | 10/2010 | Furuya et al. | 399/302 |
| 7,881,636 | B2 | 2/2011 | Furuya et al. | 399/165 |
| 2003/0118359 | A1 * | 6/2003 | Ogiyama et al. | 399/302 X |
| 2008/0118281 | A1 | 5/2008 | Saeki et al. | 399/308 |
| 2009/0003864 | A1 | 1/2009 | Yamaguchi et al. | 399/66 |
| 2009/0257764 | A1 * | 10/2009 | Okamoto | 399/66 |
| 2009/0257799 | A1 | 10/2009 | Haruno et al. | 399/360 |
| 2010/0003051 | A1 | 1/2010 | Sekina et al. | 399/121 |
| 2010/0008696 | A1 | 1/2010 | Furuya et al. | 399/101 |
| 2010/0067952 | A1 | 3/2010 | Fujita et al. | 299/168 |
| 2010/0080589 | A1 * | 4/2010 | Yoshioka | 399/66 X |
| 2010/0080625 | A1 | 4/2010 | Furuya et al. | 399/121 |
| 2011/0110676 | A1 * | 5/2011 | Higa | 399/66 X |

FOREIGN PATENT DOCUMENTS

| | | |
|---|---|---|
| JP | 7-234595 | 9/1995 |
| JP | 2009-15287 | 1/2009 |

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

An image forming apparatus includes a belt member bearing a toner image, a contact member disposed inside loop formed by the belt member, a rotary pressing member to contact the contact member through the belt member and form a nip between the contact member and the rotary pressing member via the belt member through which a recording medium is conveyed, and a transfer device to transfer the toner image onto the recording medium. An amount of winding of the belt member around the rotary pressing member is changeable between a first state in which the belt member is wound around the rotary pressing member upstream from the nip in the direction of move to the nip and a second state in which the amount of winding of the belt member around the rotary pressing member is reduced from the first state while contacting the belt member.

11 Claims, 4 Drawing Sheets

IMAGE FORMING APPARATUS INCLUDING TRANSFER ROLLER MECHANISM

CROSS-REFERENCE TO RELATED APPLICATIONS

This patent application is based on and claims priority pursuant to 35 U.S.C. §119 from Japanese Patent Application No. 2010-094956, filed on Apr. 16, 2010 in the Japan Patent Office, which is hereby incorporated herein by reference in its entirety.

BACKGROUND OF THE INVENTION

1. Field of the Invention

Exemplary aspects of the present invention generally relate to an image forming apparatus, such as a copier, a facsimile machine, a printer, or a digital multi-functional system including a combination thereof, and more particularly, to an image forming apparatus that transfers a toner image formed on a belt member onto a transfer medium such as a recording medium.

2. Description of the Background Art

Related-art image forming apparatuses, such as copiers, facsimile machines, printers, or multifunction printers having at least one of copying, printing, scanning, and facsimile functions, typically form an image on a recording medium according to image data. Thus, for example, a charging device uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

In a color-image forming apparatus, four image carriers (which may, for example, be photoconductive drums), one for each of the colors black, yellow, magenta, and cyan, are arranged in tandem facing a belt member, that is, an intermediate transfer belt, and multiple toner images of a respective single color are formed thereon. Then, the toner images are transferred onto the intermediate transfer belt so that they are superimposed one atop the other, thereby forming a composite toner image. This process is known as a "primary transfer process".

Then, the composite toner image on the intermediate transfer belt is secondarily transferred as a color toner image onto a recording medium in a nip, also known as a transfer nip, at which the intermediate transfer belt and a secondary transfer roller serving also as a pressing roller meet and press against each other. Subsequently, the recording medium bearing the color toner image which has been secondarily transferred thereto is conveyed to the fixing device, in which the color toner image is fixed with heat and pressure.

The intermediate transfer belt is generally wound around a plurality of rollers, one of which is a secondary transfer opposing roller disposed across from the secondary transfer roller via the intermediate transfer belt, thereby forming the transfer nip.

In a known image forming apparatus, electric discharge of the intermediate transfer belt and the secondary transfer roller occurs upstream from the transfer nip (that is, upstream in the direction of conveyance of the recording medium), yielding defective images. To prevent the occurrence of such defective images, a so-called pre-nip is formed by winding the intermediate transfer belt around the secondary transfer belt upstream from the transfer nip. In such a configuration, because the intermediate transfer belt contacts or is wound around a portion of an outer circumferential surface of the secondary roller upstream from the transfer nip to the transfer nip to form the pre-nip, electric discharge by the intermediate transfer belt and the secondary transfer roller is reduced significantly, preventing production of defective images.

Although advantageous and generally effective for its intended purpose, there is a drawback to this configuration in that when the intermediate transfer belt remains wound around the secondary transfer roller for an extended period of time, the intermediate transfer belt is deformed temporarily, that is, the intermediate transfer belt is undesirably curled along the outer circumferential surface of the secondary transfer roller. In particular, if the intermediate transfer belt remains in this condition in a hot and humid environment, curling becomes significant. The curled intermediate transfer belt does not move properly and causes problems such as distortion of the toner image primarily transferred onto the intermediate transfer belt in the primary transfer process.

To address this problem, when no image forming operation is performed, the secondary transfer roller can be separated from the intermediate transfer belt using a separation mechanism. This separation mechanism also separates the transfer roller from a photoconductive drum. However, the separation mechanism needs to separate repeatedly the secondary transfer roller from the intermediate transfer belt with a relatively large force, requiring considerable durability of the parts and components used in the separation mechanism and thus increasing its overall size and cost.

The difficulty described above is not limited to an image forming apparatus using the intermediate transfer belt arrangement. The same difficulty arises in image forming apparatuses using a belt member such as a photoconductive belt or the like, in which the belt member is wound around a pressing roller upstream from the nip to form the pre-nip.

BRIEF SUMMARY OF THE INVENTION

In view of the foregoing, in one illustrative embodiment of the present invention, an image forming apparatus includes a belt member, a contact member, a rotary pressing member, a transfer device, and a positioning mechanism. The belt member formed in a loop moves in a predetermined direction and bears a toner image on a surface thereof. The contact member is disposed inside the loop formed by the belt member and contacts an inner circumferential surface of the belt member. The rotary pressing member disposed outside the loop contacts the contact member through the belt member and forms a nip between the contact member and the rotary pressing member via the belt member through which a recording medium bearing the toner image is conveyed. The transfer device forms an electric field between the contact member and the rotary pressing member to transfer the toner image formed on the belt member onto the recording medium. The positioning mechanism changes an amount of winding of the belt member around the rotary pressing member between a first state in which the belt member is wound around the rotary pressing member upstream from the nip in the direction of movement to the nip and a second state in which the amount of winding of the belt member around the rotary pressing member is reduced from the first state while the rotary pressing member contacts the belt member.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
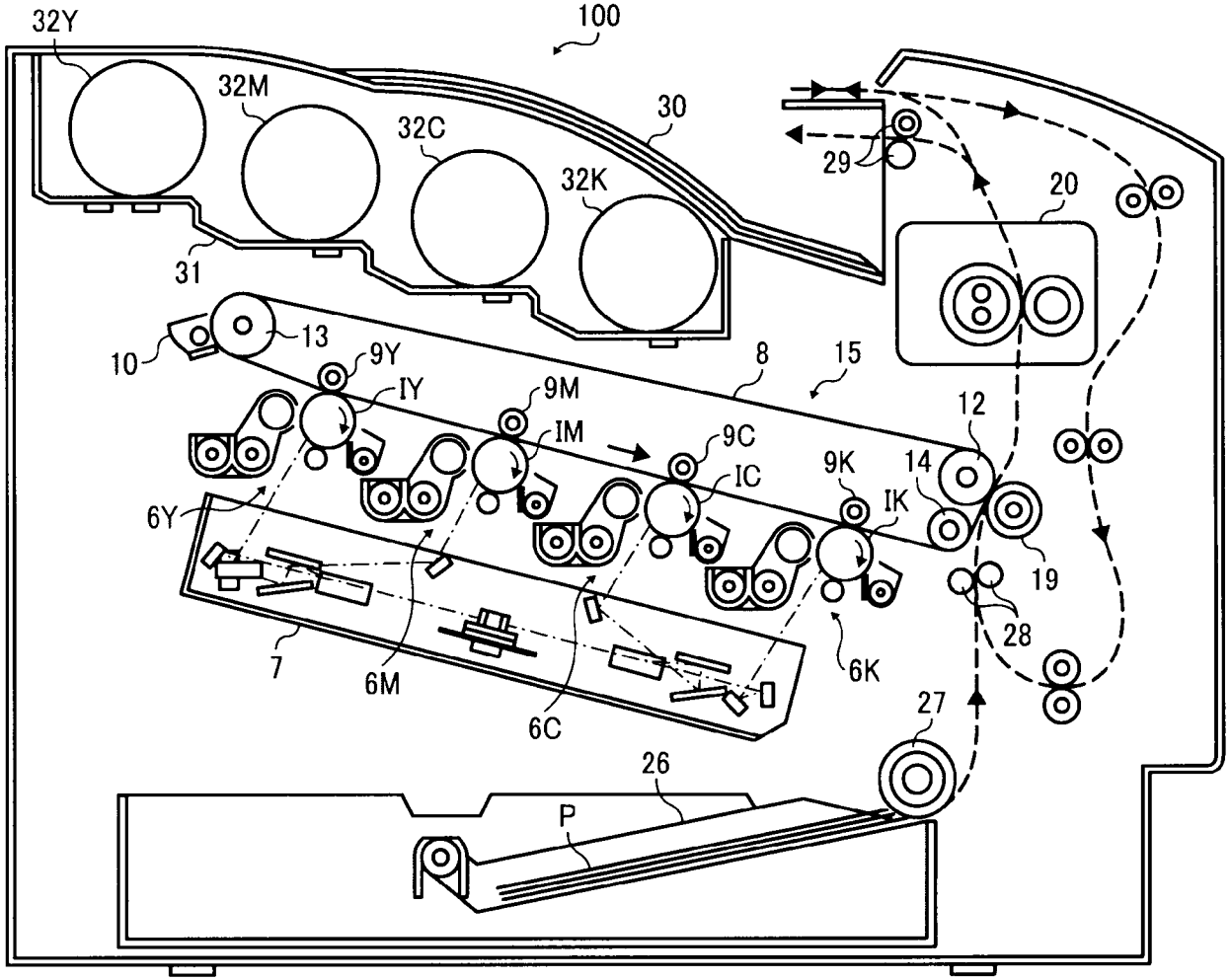
FIG. 1 is a schematic diagram illustrating the image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

DETAILED DESCRIPTION OF THE INVENTION

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, in particular to FIG. 1, one example of an image forming apparatus according to an exemplary embodiment of the present invention is explained.

With reference to FIG. 1, a description is provided of configuration and operation of an image forming apparatus 100, according to the illustrative embodiment of the present invention. FIG. 1 is a schematic diagram illustrating the image forming apparatus 100.

As illustrated in FIG. 1, the image forming apparatus 100 includes a toner storage unit 31, an intermediate transfer unit 15, image forming stations 6Y, 6M, 6C, and 6K, an exposure device 7, a fixing device 20, and so forth. It is to be noted that reference characters Y, C, M, and K denote colors yellow, cyan, magenta, and black, respectively.

The toner storage unit 31 is disposed substantially at the upper portion of the image forming apparatus 100. Four toner bottles 32Y, 32M, 32C, and 32K for yellow, magenta, cyan, and black are detachably provided to the toner storage unit 31. Substantially below the toner storage unit 31, the intermediate transfer unit 15 is disposed. The intermediate transfer unit 15 includes an intermediate transfer belt 8 serving as an image bearing member. The image forming stations 6Y, 6M, 6C, and 6K are disposed facing the intermediate transfer belt 8.

Substantially below the toner bottles 32Y, 32M, and 32C, and 32K for yellow, magenta, cyan, and black, a toner supply device, not illustrated is provided. The toner stored in the toner bottles 32Y, 32M, 32C, and 32K is supplied to developing devices of the image forming stations 6Y, 6M, 6C, and 6K by the toner supply device.

Figure 2:
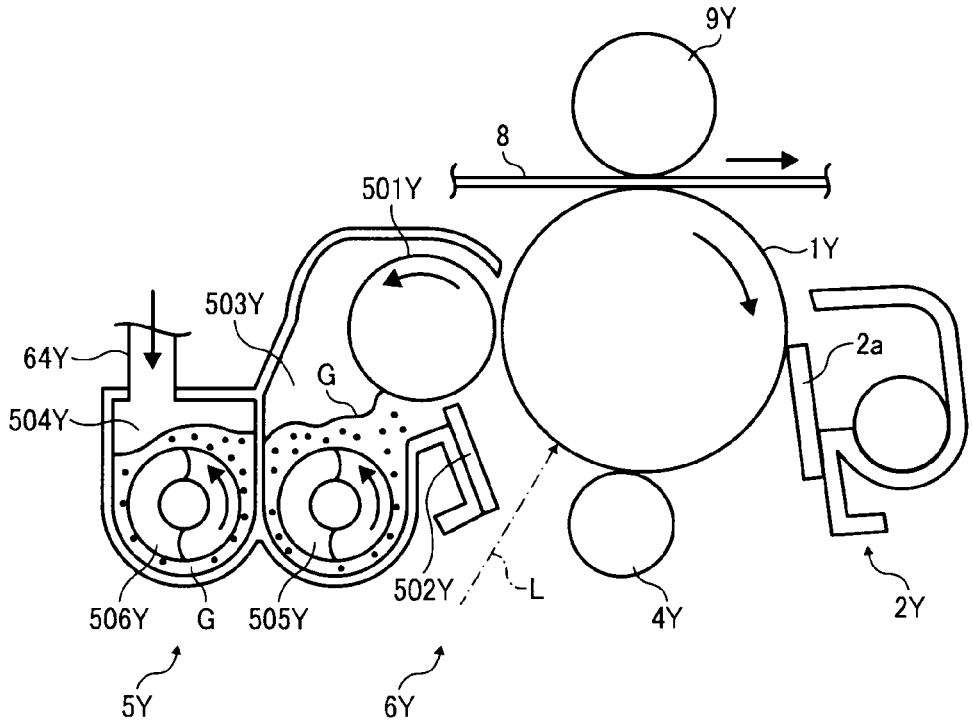
FIG. 2 is a cross-sectional view of an image forming station employed in the image forming apparatus of FIG. 1.

With reference to FIG. 2, a description is provided of the image forming station 6Y for color yellow as a representative example of the image forming station. FIG. 2 is a cross-sectional view of the image forming station 6Y. The image forming stations 6Y, 6M, 6C, and 6K all have the same configuration as all the others, differing only in the color of toner employed. Thus, a description is provided of the image forming station 6Y for yellow as a representative example of the image forming stations.

The image forming station 6Y includes a photoconductive drum 1Y, around which a charging device 4Y, a developing device 5Y, a cleaning device 2Y, a charge eraser, not illustrated, and so forth are disposed. Image forming processes including charging, exposing, development, transfer, and cleaning are performed on the photoconductive drum 1Y, thereby forming a toner image of yellow.

As illustrated in FIG. 2, the photoconductive drum 1Y rotates in a clockwise direction by a drive motor, not illustrated. When the surface of the photoconductive drum 1Y arrives at the charging device 4Y, the photoconductive drum 1Y is uniformly charged by the charging device 4Y. This is known as a charging process.

Subsequently, the exposure device 7 illuminates the surface of the photoconductive drum 1Y with light L, thereby forming an electrostatic latent image for yellow. This is known as an exposure process.

As the surface of the photoconductive drum 1Y comes to the developing device 5Y, the electrostatic latent image is developed with toner of yellow, thereby forming a toner image of yellow. This is known as a developing process.

As illustrated in FIG. 2, a two-component developing agent G consisting of toner and carriers (magnetic carriers) is stored in the developing device 5Y. A density of toner in the developing agent G, that is, a ratio of toner in the developing agent G in the developing device 5Y, is detected by a magnetic detector, not illustrated, and adjusted to be in a certain range. In other words, in accordance with consumption of toner in the developing device 5Y, the toner supply device supplies toner to a second chamber 504Y through a toner supply path 64Y.

Although not illustrated, the toner supply device is connected to the toner bottle 32Y shown in FIG. 1. The toner supply device includes a drive unit to rotate the toner bottle 32Y, a toner tank to store toner discharged from the toner bottle 32Y, a toner conveyer to convey the toner in the toner tank to a toner drop path from which the toner conveyed by the toner conveyer is dropped to the developing device 5Y under its own weight, and so forth.

As illustrated in FIG. 2, while the toner supplied to the second chamber 504Y through the toner supply path 64Y is mixed and shaken with the developing agent G by two conveyance paddles 505Y and 506Y, the developing agent G circulates in a first chamber 503Y and the second chamber 504Y separated by a wall. The toner in the developing agent G circulating in a circulation path sticks to the carriers due to frictional charging with the carriers. Then, the toner and the carriers are borne on a developing roller 501Y, on which a plurality of magnetic poles is formed.

The developing agent G borne on the developing roller 501Y is conveyed to a doctor blade 502Y as the developing roller 501Y rotates in a direction indicated by an arrow.

Subsequently, after an amount of the developing agent G on the developing roller 501Y is adjusted to a proper amount, the developing agent G is conveyed to a developing area opposite the photoconductive drum 1Y.

An electric field (development electric field) formed in the developing area causes the toner to stick to the latent image formed on the photoconductive drum 1Y. The density of the toner (ratio of toner) in the developing agent G in the developing device 5Y is adjusted to be in a certain range. More specifically, in accordance with consumption of the toner in the developing device 5Y, the toner supply device supplies toner in the toner bottle 32Y to the second chamber 504Y through the toner supply path 64Y.

After the developing process as described above, as the toner image on the photoconductive drum 1Y arrives at a position opposite a primary transfer bias roller 9Y via the intermediate transfer belt 8, the toner image is primarily transferred onto the intermediate transfer belt 8 serving as an image bearing member. This process is a so-called primary transfer process. After the primary transfer process, a small amount of toner (residual toner), which has not been transferred onto the intermediate transfer belt 8, remains on the photoconductive drum 1Y.

As the photoconductive drum 1Y rotates, a cleaning blade 2*a* of the cleaning device 2Y mechanically collects the residual toner on the surface of the photoconductive drum 1Y.

Lastly, the surface of the photoconductive drum 1Y comes to the charge eraser, not illustrated. The charge eraser removes residual potential from the surface of the photoconductive drum 1Y in preparation for the subsequent imaging cycle, thereby completing a sequence of the image forming processes on the photoconductive drum 1Y.

It is to be noted that the same image forming processes are performed in the image forming stations 6M, 6C, and 6K.

Similar to the image forming station 6Y, the exposure device 7 disposed below the image forming stations illuminates the photoconductive drums 1M, 1C, and 1K with the light L based on image information of a document. More specifically, the exposure device 7 projects the light L from a light source. A polygonal mirror scans the light L projected from the light source, to illuminate the photoconductive drums through a plurality of optical elements while the polygonal mirror rotates. Then, after the developing process, the toner images of each color formed on the photoconductive drums are primarily and overlappingly transferred onto the intermediate transfer belt 8, thereby forming a composite toner image.

Referring back to FIG. 1, a description is provided of the intermediate transfer unit 15. The intermediate transfer unit 15 includes the intermediate transfer belt 8, four primary transfer bias rollers 9Y, 9M, 9C, and 9K, a secondary transfer opposing roller 12 serving as a contact member, a first tension roller 13, a second tension roller 14, a cleaning device 10, and so forth.

The intermediate transfer belt 8 is wound around and stretched between the secondary transfer opposing roller 12, the first tension roller 13, and the second tension roller 14. The intermediate transfer belt 8 is rotated by one roller, here, the secondary transfer opposing roller 12, in the direction indicated by an arrow in FIG. 1.

According to the illustrative embodiment, the second tension roller 14 serves as an encoder roller to detect a moving speed of the intermediate transfer belt 8. More specifically, a disk, on which a plurality of slits is radially formed with a certain pitch, is provided to a shaft of the second tension roller 14. A photo sensor is provided opposite the disk to detect the slits. The photo sensor detects a number of rotations of the second tension roller 14 or the disk. Based on a detection result, the moving speed of the intermediate transfer belt 8 is adjusted.

The primary transfer bias rollers 9Y, 9M, 9C, and 9K, and the photoconductive drums 1Y, 1M, 1C, and 1K sandwich the intermediate transfer belt 8 to form a primary transfer nip. The primary transfer bias rollers 9Y, 9M, 9C, and 9K are supplied with a transfer bias opposite a polarity of the toner. The intermediate transfer belt 8 moves in the direction of arrow, passing through the primary transfer nips defined by the primary transfer bias rollers 9Y, 9M, 9C, and 9K, and the photoconductive drums 1Y, 1M, 1C, and 1K, respectively. Accordingly, the toner images formed on the photoconductive drums 1Y, 1M, 1C, and 1K are primarily and overlappingly transferred onto the intermediate transfer belt 8, thereby forming the composite toner image on the surface of the intermediate transfer belt 8.

Subsequently, the intermediate transfer belt 8 bearing the composite toner image arrives at a secondary transfer nip defined by a secondary transfer roller 19 (transfer member) serving as a pressing roller and the secondary transfer opposing roller 12 serving as a contact member. The intermediate transfer belt 8 is sandwiched by the secondary transfer roller 19 and the secondary transfer opposing roller 12.

Subsequently, the secondary transfer roller 19 is supplied with a secondary transfer bias opposite the polarity of the toner. Alternatively, the secondary transfer opposing roller 12 may be supplied with the secondary transfer bias having the same polarity as the toner.

The composite toner image on the intermediate transfer belt 8 is transferred onto a transfer medium such as a recording medium P conveyed to the secondary transfer nip. Some toner (residual toner) having not been transferred onto the recording medium P remains on the intermediate transfer belt 8.

The intermediate transfer belt 8 arrives at the cleaning device 10 which collects the residual toner. The residual toner is collected by the cleaning device 10, thereby completing a sequence of the transfer process.

The recording medium P is supplied from a sheet feeding unit 26 disposed substantially at the bottom of the image forming apparatus 100 and conveyed to the transfer nip, that is, the secondary transfer nip, through a sheet feed roller 27, a pair of registration rollers 28, and so forth. In the sheet feeding unit 26, a plurality of transfer sheets such as recording media sheets P is stacked.

As the sheet feed roller 27 rotates in the counterclockwise direction in FIG. 1, the sheet feed roller 27 picks up a top sheet in the sheet feeding unit 26 and feeds the top sheet to the pair of registration rollers 28.

The recording medium P is temporarily stopped at the pair of registration rollers 28 rotation of which is also stopped. Rotation of the pair of registration rollers 28 resumes, and the recording medium P is sent to the secondary transfer nip in appropriate timing such that the recording medium P is aligned with the composite toner image formed on the intermediate transfer belt 8. Accordingly, the composite toner image (color image) is transferred onto the recording medium P.

The recording medium P, on which the composite toner image is transferred in the secondary transfer nip, is conveyed to the fixing device 20. In the fixing device 20, the composite toner image transferred onto the recording medium P is fixed on the recording medium P with heat and pressure, thereby forming a color image on the recording medium P. The recording medium P on which the color image is fixed is discharged outside the image forming apparatus 100 through a pair of sheet discharge rollers 29.

The recording medium P on which the color image is fixed is discharged outside the image forming apparatus 100, that is, onto a sheet stack portion 30, thereby completing a sequence of image forming processes in the image forming apparatus 100.

According to the illustrative embodiment, the intermediate transfer belt 8 includes a single layer or multiple layers including, but not limited to, polyimide (PI), polyvinylidene fluoride (PVDF), ethylene tetrafluoroethylene (ETFE), and polycarbonate (PC), with conductive material such as carbon black is dispersed.

The volume resistivity of the intermediate transfer belt 8 is in a range from approximately $10^7\Omega$ to $10^{12}\Omega$. The thickness thereof is in a range from approximately 80 μm to 100 μm.

It is to be noted that the surface of the intermediate transfer belt 8 may be coated with a release layer, as necessary. The release layer may include, but is not limited to, fluorocarbon resin such as ETFE, polytetrafluoroethylene (PTFE), PVDF, perfluoroalkoxy polymer resin (PFA), fluorinated ethylene propylene (FEP), and polyvinyl fluoride (PVF).

The intermediate transfer belt 8 is manufactured through a casting process, a centrifugal casting process, and the like. The surface of the intermediate transfer belt 8 may be ground, as necessary.

The secondary transfer opposing roller 12 serving as a contact member is disposed in the inner loop formed by the intermediate transfer belt 8 and contacts the secondary transfer roller 19 (transfer member) serving as a pressing roller through the intermediate transfer belt 8.

The secondary transfer roller 19 is constructed of a metal core on which an elastic layer (conductive rubber layer)

including urethane material (urethane rubber) is provided. A rubber hardness of the elastic layer is in a range from approximately 48 Hs to 58 Hs. The secondary transfer roller 19 contacts the secondary transfer opposing roller 12 through the intermediate transfer belt 8, thereby forming a nip N1 (shown in FIG. 5A).

As described above, a desired electric field is formed between the secondary transfer roller 19 and the secondary transfer opposing roller 12 (or the intermediate transfer belt 8), thereby secondarily transferring the toner image on the intermediate transfer belt 8 onto the recording medium P in the nip N1. According to the illustrative embodiment, in the secondary transfer process, the secondary transfer roller 19 is supplied with a predetermined voltage (secondary transfer bias) from a power source, not shown. The secondary transfer roller 19, the power source, and so forth serve as a transfer mechanism to perform the secondary transfer process.

Figure 3:
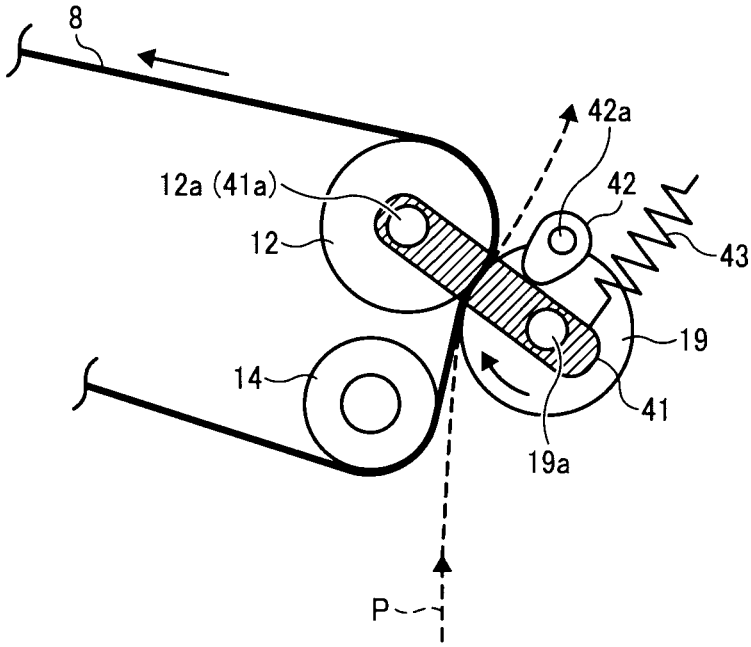
FIG. 3 is an enlarged diagram illustrating an intermediate transfer belt and a secondary transfer roller employed in the image forming apparatus during the second transfer process.

When the image forming apparatus 100 is in operation, the intermediate transfer belt 8 rotates in a predetermined direction, generating friction resistance with the secondary transfer roller 19 at the nip N1. Accordingly, the secondary transfer roller 19 serving as a pressing roller is rotated in the clockwise direction indicated by an arrow in FIG. 3. FIG. 3 is an enlarged diagram illustrating the intermediate transfer belt 8 and the secondary transfer roller 19 during the second transfer process.

Figure 4:
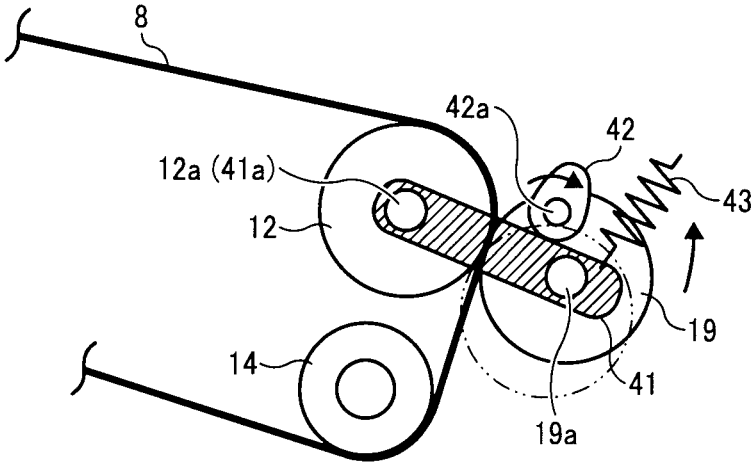
FIG. 4 is an enlarged diagram illustrating the intermediate transfer belt and the secondary transfer roller moving from the position shown in FIG. 3.

With reference to FIGS. 3 and 4, a description is provided of configuration and operation of an image forming apparatus 100, according to the illustrative embodiment of the present invention. FIG. 4 is an enlarged diagram illustrating the intermediate transfer belt 8 and the secondary transfer roller 19 moving from the position shown in FIG. 3.

Figure 5A:
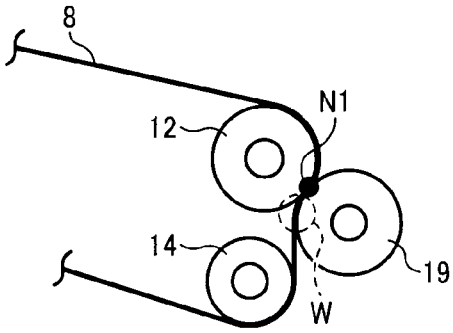
FIG. 5A is an enlarged diagram illustrating the intermediate transfer belt in a first state in which a pre-nip W is formed.
Figure 5B:
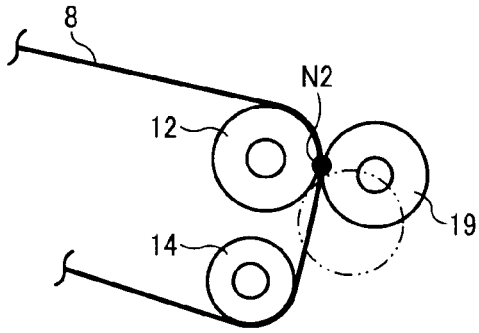
FIG. 5B is an enlarged diagram illustrating the intermediate transfer belt in a second state in which no pre-nip W is formed.

According to the illustrative embodiment, in the image forming apparatus 100, an amount of the intermediate transfer belt 8 wound around the secondary transfer roller 19 is changeable between a first state as illustrated in FIGS. 3 and 5A and a second state as illustrated in FIGS. 4 and 5B. That is, when the intermediate transfer belt 8 is in the first state, the intermediate transfer belt 8 is wound around or contacts the secondary transfer roller 19 upstream from the nip N1 in the moving direction of the intermediate transfer belt 8 to the nip N1, thereby forming a pre-nip W as illustrated in FIG. 5A. FIG. 5A is an enlarged diagram illustrating the intermediate transfer belt in a first state in which a pre-nip W is formed.

By contrast, when the intermediate transfer belt 8 is in the second state as illustrated in FIG. 5B, the amount of the intermediate transfer belt 8 wound around the secondary transfer roller 19 or the pre-nip W is reduced while contacting the intermediate transfer belt 8. In other words, the pre-nip W is eliminated. FIG. 5B is an enlarged diagram illustrating the intermediate transfer belt in a second state in which no pre-nip W is formed.

During the secondary transfer process at the nip, the intermediate transfer belt 8 is in the first state as illustrated in FIGS. 3 and 5A. By contrast, when no secondary transfer process is performed at the nip, the intermediate transfer belt 8 is in the second state as illustrated in FIGS. 4 and 5B.

In other words, during the image forming operation, the secondary transfer process is performed while the pre-nip W is formed. By contrast, when no image forming operation is performed, the pre-nip W is not formed and the operation of the image forming apparatus 100 is halted.

As described above, FIGS. 3 and 5A illustrate the first state in which the secondary transfer process is performed, and depending on the position of the second tension roller 14, a certain amount of the intermediate transfer belt 8 is wound around the secondary transfer roller 19 upstream from the nip N1 (secondary transfer nip) in the direction of rotation of the secondary transfer roller 19, forming the pre-nip W.

According to the illustrative embodiment, the amount of the intermediate transfer belt 8 wound around the secondary transfer roller 19 in the first state is approximately 2 mm in a circumferential direction of the secondary transfer roller 19. The intermediate transfer belt 8 wound around the secondary transfer roller 19 upstream from the nip N1 serves as the pre-nip W.

Figure 6:
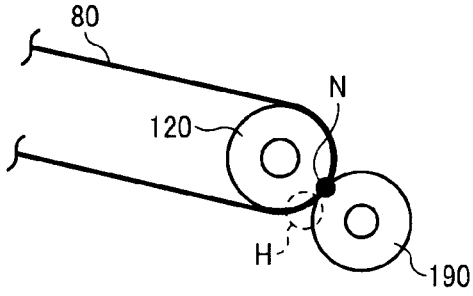
FIG. 6 RELATED ART
FIG. 6 is a schematic diagram illustrating a related-art secondary transfer roller and an intermediate transfer belt.

In order to facilitate an understanding of the novel features of the present invention, with reference to FIG. 6, a description is provided of an advantage of the pre-nip W. FIG. 6 is a schematic diagram illustrating a related-art secondary transfer roller and an intermediate transfer belt. In FIG. 6, a secondary transfer roller 190 contacts an intermediate transfer belt 80 only at a secondary nip N between the secondary transfer roller 190 and a secondary transfer opposing roller 120. In this case, a slight gap H is formed between the intermediate transfer belt 80 and the secondary transfer roller 190 substantially near the upstream of the secondary transfer nip N, and hence electric discharge occurs in the gap H, yielding defective images.

By contrast, the pre-nip W of the image forming apparatus according to the illustrative embodiment prevents the undesirable electric discharge between the intermediate transfer belt 8 and the secondary transfer roller 19 upstream from the secondary nip N, thus preventing production of defective images.

Although advantageous, because the intermediate transfer belt 8 is wound along the curve of the secondary transfer roller 19 (the outer circumferential surface) in the direction opposite the direction of wind around the secondary transfer opposing roller 12 as illustrated in FIG. 5A, the intermediate transfer belt 8 may easily deform (curl) if the image forming apparatus 100 remains in this condition (in particular, in a hot and humid environment) for an extended period of time.

In view of the above, according to the illustrative embodiment, when no image forming operation is performed, the intermediate transfer belt 8 is changed from the first state in which the pre-nip W is formed as illustrated in FIG. 5A to the second state in which no pre-nip W is formed as illustrated in FIG. 5B. With this configuration, the intermediate transfer belt 8 is prevented from getting deformed.

With reference to FIGS. 3 and 4, a description is provided of a positioning mechanism that enables the intermediate transfer belt 8 to change between the first state and the second state.

As illustrated in FIG. 3, the positioning mechanism includes an arm 41, a tension spring 43 serving as a biasing member, a cam 42, a stepping motor (not shown) and so forth. Although not illustrated, the positioning mechanism is disposed at both lateral ends in a width direction of the secondary transfer roller 19.

The arm 41 rotatably supports both the secondary transfer roller 19 and the secondary transfer opposing roller 12. Holes are provided at the end portions of the arm 41 in a longitudinal direction, into which a shaft 19*a* of the secondary transfer roller 19 and a shaft 12*a* of the secondary transfer opposing roller 12 are inserted through the holes of the arm 41 through shaft bearings. The arm 41 is rotatably supported by a frame, not illustrated, of the image forming apparatus 100 and pivots, or rotates, about a rotary shaft 41*a* at one end. In the illustrative embodiment, the position of the rotary shaft 41*a* of the arm 41 coincides with the position of the shaft 12*a* of the secondary transfer opposing roller 12. In this configuration, the arm 41 rotates about the rotary shaft 41*a*, moving the secondary transfer roller 19 so as to change the position of the nip (the secondary transfer nip) along the circumferential direction of the secondary transfer opposing roller 12.

One end of the tension spring 43 serving as a biasing member is connected to one end portion of the arm 41, and the other end of the tension spring 43 is connected to the frame (not shown) of the image forming apparatus 100. The tension spring 43 biases the arm 41 in a predetermined direction. More specifically, the tension spring 43 biases the arm 41 in the direction substantially perpendicular to the longitudinal direction of the arm 41, that is, the direction of a line connected between the shaft 12*a* and the shaft 19*a*.

The cam 42 contacts what is substantially the center of the arm 41 in the longitudinal direction to press the arm 41 against the spring force of the tension spring 43. The cam 42 is rotated by a stepping motor (not shown) connected to a shaft 42*a*, thereby adjusting the orientation of the cam 42 in the direction of rotation. With this configuration, by controlling the stepping motor, the orientation of the cam 42 in the direction of rotation is changed, enabling the arm 41 to rotate to change the amount of the intermediate transfer belt 8 wound around the secondary transfer roller 19 between the first state and the second state.

More specifically, when the cam 42 is at the position illustrated in FIG. 3, the cam 42 presses the arm 41 against the spring force of the tension spring 43 to move the arm 41 upstream in the direction of movement of the intermediate transfer belt 8. Accordingly, the secondary transfer roller 19 is positioned as illustrated in FIG. 3, which corresponds to the first state illustrated in FIG. 5A, thereby forming the pre-nip W upstream from the nip N1. In this state, the secondary transfer process is performed.

By contrast, when the cam 42 rotates approximately 180 degrees about the shaft 42*a* as illustrated in FIG. 4, the spring force of the tension spring 43 causes the arm 41 to rotate about the rotary shaft 41*a* in the counterclockwise direction, thereby moving the secondary transfer roller 19 downstream in the direction of movement of the intermediate transfer belt 8. With this configuration, the secondary transfer roller 19 moves to the position illustrated in FIG. 4, thereby moving a nip N2 downstream and thus eliminating the pre-nip W as illustrated in FIG. 5B which is the second state.

In the second state as illustrated in FIG. 5B, the amount of the intermediate transfer belt 8 wound around the secondary transfer roller 19 is changed from 2 mm to 0 mm, for example. In the second state, the secondary transfer process is not performed.

The advantage of the foregoing arrangement is that the secondary transfer roller 19 is moved slightly in the direction substantially perpendicular to the pressing direction of the secondary transfer roller 19 against the secondary transfer opposing roller 12, thus requiring only very small force for moving the secondary transfer roller 19. Furthermore, no large installation site is required.

As described above, the amount of the intermediate transfer belt 8 wound around the secondary transfer roller 19 is 0 mm in the second state. However, the amount of the intermediate transfer belt 8 wound around the secondary transfer roller 19 is not limited thereto. As long as the amount of the intermediate transfer belt 8 wound around the secondary transfer roller 19 is reduced from the first state, deformation or curling of the intermediate transfer belt 8 is reduced.

According to the illustrative embodiment, preferably, switching between the first state and the second state is performed by the positioning mechanism when no image forming process is performed in the image forming apparatus 100. For example, switching between the first state and the second state may be performed during warm-up, after completion of job, and so forth. With this configuration, undesirable vibration is prevented from permeating the image forming devices such as the intermediate transfer belt 8 and the photoconductive drums 1Y, 1M, 1C, and 1K, thus preventing degradation of an image.

According to the illustrative embodiment, as described above, the secondary transfer roller 19 is not driven directly by a drive motor or receives drive force from a gear train. The friction resistance with the intermediate transfer belt 8 at the nip N1 causes the secondary transfer roller 19 to rotate. In this configuration, the positioning mechanism including the arm 41, the tension spring 43, the cam 42, and so forth moves the secondary transfer roller 19 along the outer circumference of the secondary transfer opposing roller 12 while the secondary transfer roller 19 rotates. Accordingly, load on the positioning mechanism or the stepping motor is reduced when the secondary transfer roller 19 is moved.

According to the illustrative embodiment, in the second state, the secondary transfer roller 19 still contacts and presses against the secondary transfer opposing roller 12 through the intermediate transfer belt 8. However, because the secondary transfer roller 19 includes the elastic layer made of urethane material, permanent deformation of the secondary transfer roller 19 is prevented even when the secondary transfer roller 19 remains in contact with the secondary opposing roller 12 through the intermediate transfer belt 8 for an extended period of time.

According to the illustrative embodiment, the position of the secondary transfer opposing roller 12 serving as a contact member is fixed by the positioning mechanism while the secondary transfer roller 19 serving as a rotary pressing member is movable. Alternatively, the secondary transfer roller 19 may be fixed by the positioning mechanism, and the secondary transfer opposing roller 12 is moved by the positioning mechanism. In such a configuration, the same effect as that of the foregoing embodiments can be achieved.

According to the illustrative embodiment, the arm 41 is positioned to contact the cam 42 in the second state as illustrated in FIG. 4. Alternatively, a projection may be provided to the frame of the image forming apparatus 100 so that the arm 41 contacts the projection in the second state to be positioned in place. In such a configuration, the same effect as that of the foregoing embodiments can be achieved.

According to the illustrative embodiment, a spring serving as a biasing member may be provided to bias the secondary transfer roller 19 against the secondary transfer opposing roller 12 to form the nip N1. In this case, a slot (elongated hole) is formed in the arm 41 such that the shaft 19*a* of the secondary transfer roller 19 can move in the slot towards the secondary transfer opposing roller 12. In such a configuration, the same effect as that of the other foregoing embodiments can be achieved.

According to the illustrative embodiment, the amount of the intermediate transfer belt 8 wound around the secondary transfer roller 19 is changeable between the first state in which the pre-nip W is formed and the second state in which the pre-nip W is not formed while contacting the intermediate transfer belt 8. With this configuration, a defective image such as a scattered image due to electric discharge is prevented, and undesirable curling of the intermediate transfer belt 8 is prevented even when the intermediate transfer belt 8 remains wound around the secondary transfer roller 19 for an extended period of time.

Furthermore, the present invention may be applied to an image forming apparatus using a belt member, other than the intermediate transfer belt 8, for example, a photoconductive belt, and the like. In such an image forming apparatus, the pre-nip is formed by winding the belt member around the rotary pressing member upstream from the nip defined between the rotary pressing member and the contact member disposed substantially opposite the rotary pressing member.

The same effect as that of the foregoing embodiments can be achieved when the amount of winding of the belt member around the rotary pressing member is changeable between the first state and the second state.

According to the illustrative embodiment, the present invention is employed in an image forming apparatus. The image forming apparatus includes, but is not limited to, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a belt member formed in a loop, to move in a predetermined direction and bear a toner image on a surface thereof;

a contact member disposed inside the loop formed by the belt member, to contact an inner circumferential surface of the belt member;

a rotary pressing member disposed outside the loop, to contact the contact member through the belt member and form a nip between the contact member and the rotary pressing member via the belt member through which a recording medium bearing the toner image is conveyed;

a transfer device to form an electric field between the contact member and the rotary pressing member to transfer the toner image formed on the belt member onto the recording medium; and a positioning mechanism that changes an amount of winding of the belt member around the rotary pressing member between a first state in which the belt member is wound around the rotary pressing member upstream from the nip in the direction of movement to the nip and a second state in which the amount of winding of the belt member around the rotary pressing member is reduced from the first state while the rotary pressing member contacts the belt member.

2. The image forming apparatus according to claim 1, wherein the positioning mechanism comprises:

an arm member to rotatably hold the contact member and the rotary pressing member, and rotate about a rotary shaft to move at least one of the rotary pressing member and the contact member so as to change the position of the nip;

a biasing member to bias the arm member in a predetermined direction; and a cam to press the arm member against a biasing force of the biasing member and to rotatably move the arm member by changing an orientation of the cam in a direction of rotation of the cam, to change the belt member between the first state and the second state.

3. The image forming apparatus according to claim 2, wherein the biasing member is a tension spring.

4. The image forming apparatus according to claim 1, wherein the transfer device transfers the toner image onto the recording medium with the belt member in the first state.

5. The image forming apparatus according to claim 1, wherein the belt member is in the second state when the transfer device does not transfer the toner image onto the recording medium.

6. The image forming apparatus according to claim 1, wherein the belt member is changed between the first state and the second state when no image forming operation is performed.

7. The image forming apparatus according to claim 1, wherein the rotary pressing member is moved by friction resistance with the belt member at the nip.

8. The image forming apparatus according to claim 1, wherein the rotary pressing member includes an elastic layer made of urethane material.

9. The image forming apparatus according to claim 1, wherein the amount of winding of the belt member around the outer circumference of the pressing member is 0 (zero) in the second state.

10. The image forming apparatus according to claim 1, wherein the belt member is in the first state when a portion of the rotary pressing member contacts a portion of the belt member that is not contact with the contact member.

11. The image forming apparatus according to claim 1, further comprising a second contact member inside the loop formed by the belt member upstream of the contact member and the rotary pressing member, wherein the amount of winding of the belt member around the rotary pressing member corresponds to a position of the second contact member relative to the contact member.

* * * * *